United States Patent [19]

McJunkin, Jr.

[11] 4,158,880

[45] Jun. 19, 1979

[54] MINE MACHINE LIGHT

[75] Inventor: Howard P. McJunkin, Jr., Charleston, W. Va.

[73] Assignee: McJunkin Corporation, Charleston, W. Va.

[21] Appl. No.: 818,664

[22] Filed: Jul. 25, 1977

[51] Int. Cl.[2] ..... F21V 15/00; H01R 13/60; F21L 7/00; F21V 23/00

[52] U.S. Cl. ..... 362/376; 339/119 L; 362/89; 362/164; 362/367

[58] Field of Search ..... 362/89, 164, 158, 267, 362/344, 376–378, 367–369, 374, 375; 339/119 L, 182 L

[56] References Cited

U.S. PATENT DOCUMENTS

| | | | |
|---|---|---|---|
| 2,413,381 | 12/1946 | Rylsky | 362/382 |
| 2,752,480 | 6/1956 | Priebe | 362/382 |
| 3,569,692 | 3/1971 | Johnson | 362/267 |
| 4,069,415 | 1/1978 | Dacal | 362/267 |

*Primary Examiner*—Samuel W. Engle
*Assistant Examiner*—Donald P. Walsh
*Attorney, Agent, or Firm*—Cushman, Darby & Cushman

[57] ABSTRACT

The light has an explosion-proof housing that is of generally triangular transverse section, with no glass on the narrow front or top wall. In mine use, should rock drop onto the housing it is likely to strike glass parts only a glancing blow. The glass parts are arranged to be resiliently sealed to the cast or fabricated metal body of the housing, but be removable from the outside, so a broken glass part need not cost a whole light fixture. A spring resiliently supports the outer end of the bulb upon the housing to cushion against mechanical jolts.

8 Claims, 6 Drawing Figures

MINE MACHINE LIGHT

BACKGROUND OF THE INVENTION

In recent years, better mine lighting has become a requirement. However, the combination of conditions mine lighting must meet is unique. Such lighting as was immediately available when Federal legislation mandated improved lighting has not been conceived with as much and as broad attention as thereafter has come to bear on this part of technology.

In the course of preparing this disclosure of the invention, the inventor has become aware of the following prior U.S. patents.

The following show lamp housings that present lenses at an angle in a generally triangular arrangement.

U.S. Pat. No. Des.35,857; Pause; Apr. 8, 1902
U.S. Pat. No. Des.60,322; Damm; Feb. 7, 1922
U.S. Pat. No. Des.71,571; Wilhelm; Nov. 30, 1926
U.S. Pat. No. 2,018,788; Johnson; Oct. 29, 1935
U.S. Pat. No. 2,413,381; Rylsky; Dec. 31, 1946
U.S. Pat. No. 2,752,480; Priebe; June 26, 1956

SUMMARY OF THE INVENTION

The light has an explosion-proof housing that is of generally triangular transverse section, with no glass on the narrow front or top wall. In mine use, should rock drop onto the housing it is likely to strike glass parts only a glancing blow. The glass parts are arranged to be resiliently sealed to the cast or fabricated metal body of the housing, but be removable from the outside, so a broken glass part need not cost a whole light fixture. A spring resiliently supports the outer end of the bulb upon the housing to cushion against mechanical jolts.

The presently contemplated primary field of use for the lamp is as a light fixture for mounting on an underground mining machine, not as a headlight, but on top or on the sides of the machine for illuminating the mine wall or roof. Of course, the same lamp could be used elsewhere.

The features of the presently preferred embodiment of the lamp are particularly noteworthy:

(1) Note "triangular" shape with no glass on the narrow front or top wall. If a rock drops onto the fixture, it will hit the metal part between the glass parts, or will strike the glass part a striking glance and be less likely to break it.

(2) In contrast to the prior art the inventors know about, the glass windows are resiliently mounted and can be changed from the outside, because they are sealed into the recess of the rim of the housing, then the rectangular retainer is put against the glass and housing and bolted on. Resilient silicone rubber sealant/adhesive ("RTV") or equivalent shall be used.

(3) There is a spring which is inserted between the outer end of the light bulb and the end cap of the housing. This resiliently supports the bulb end to prevent the bulb from rapping against the inside of the housing as the mining machine is jolted during use.

It should be noted that while this light is specifically tailored for mine use, by having an explosion-proof housing, the features that make it explosion-proof have been used in housings of substantially different design. In general, should an explosion take place for whatever reason within the housing, the path by which the hot gases would begin to escape is along screw threading between housing parts. By the time the gases have traversed the path, they exit from the housing too cooled to initiate an explosion of mine gases.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION OF THE PRESENTLY PREFERRED EMBODIMENT

Figure 1:
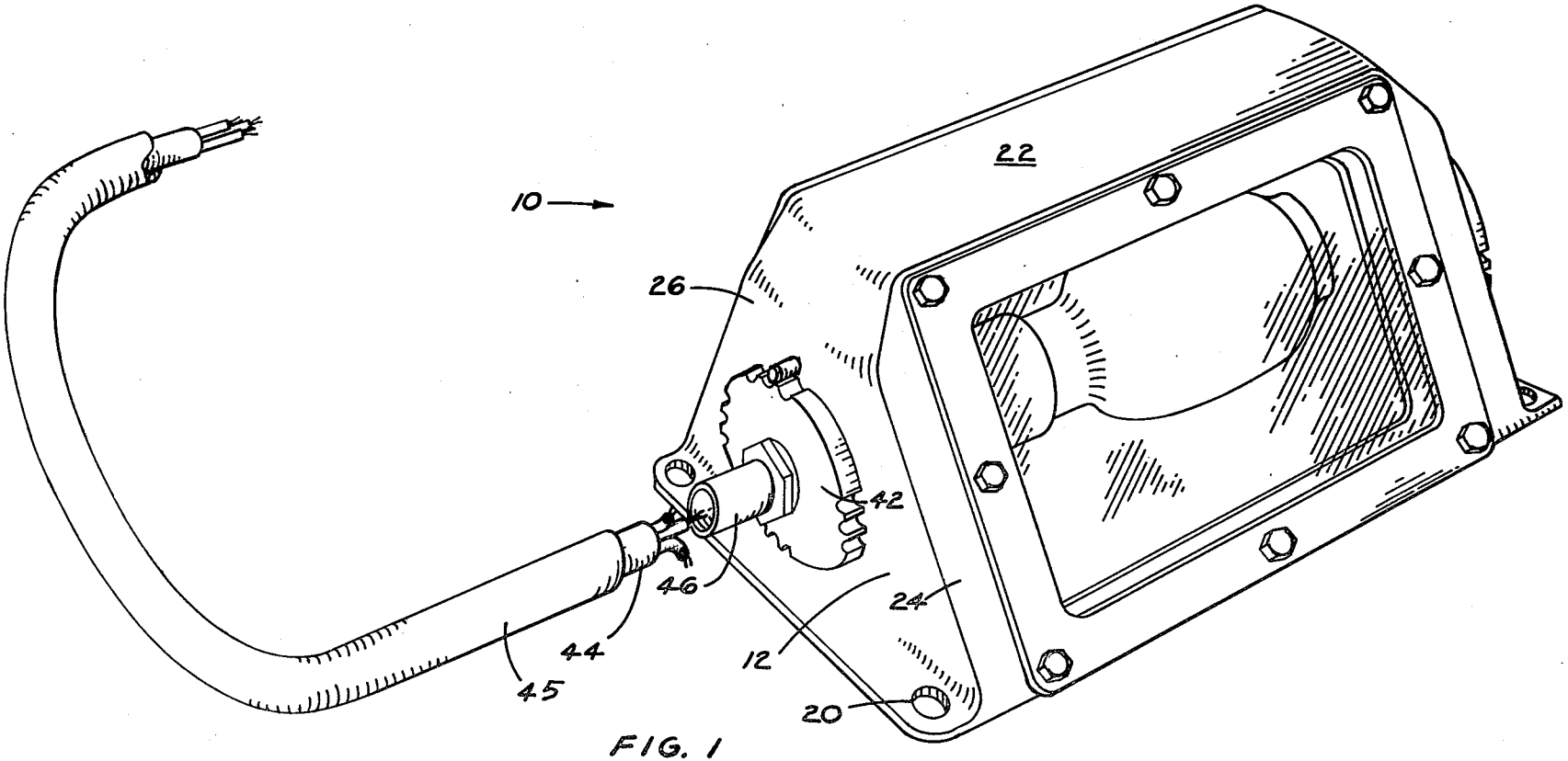
FIG. 1 is a perspective view of the mine machine light.
Figure 2:
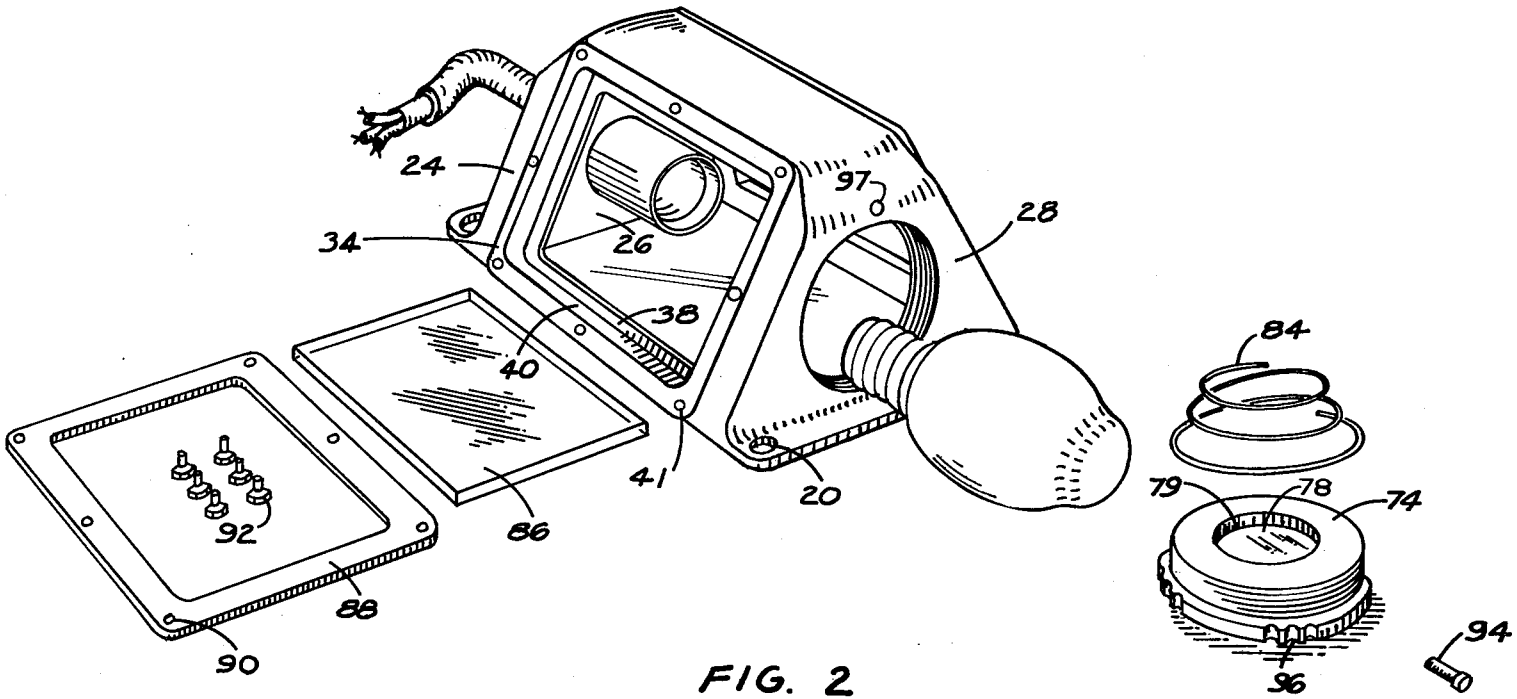
FIG. 2 is an exploded perspective view of the mine machine light of FIG. 1.
Figures 3, 4, 4A, 4B:
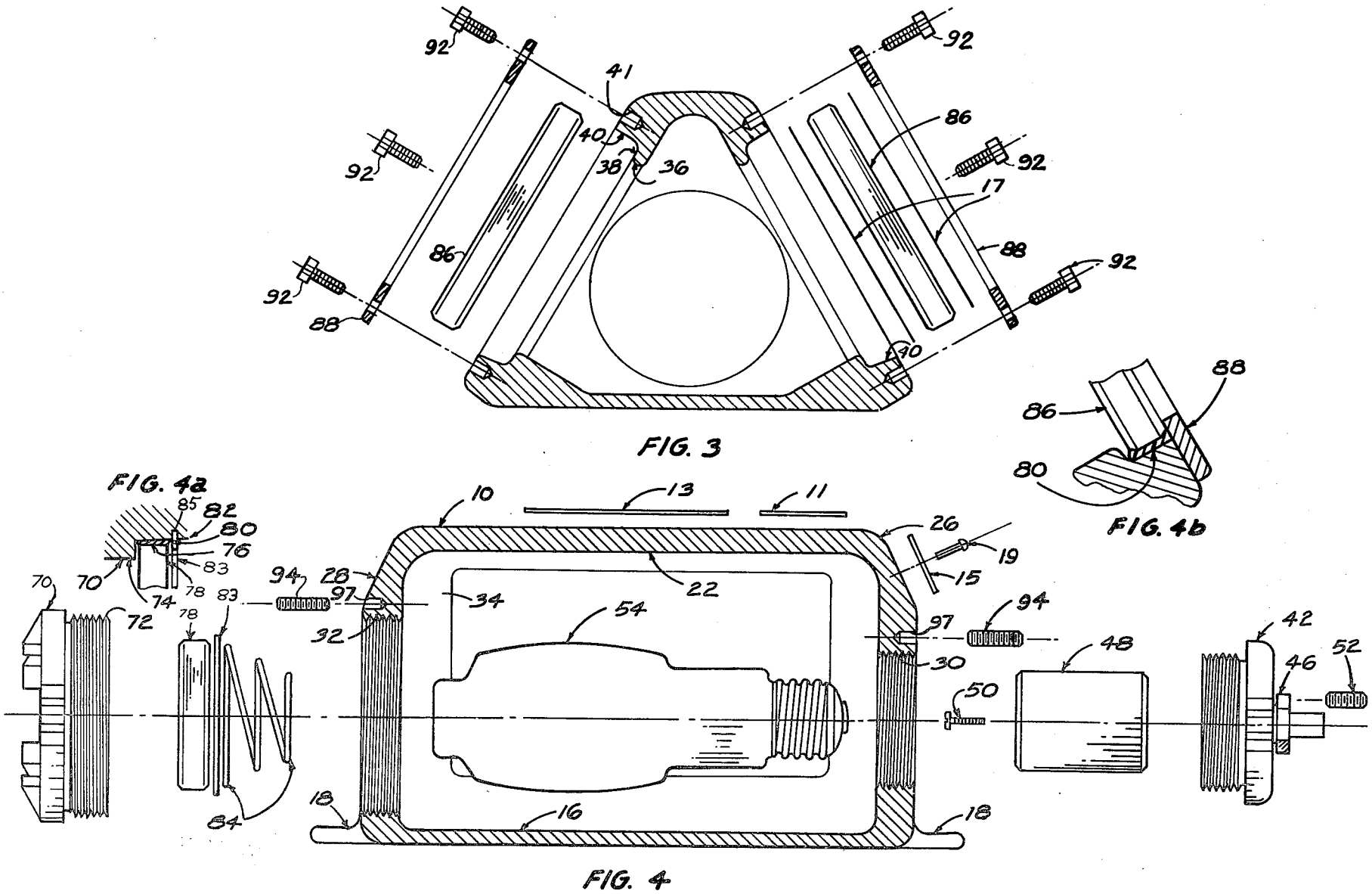
FIG. 3 is an exploded transverse cross-sectional view thereof depicting an intermediate portion.
FIG. 4 is a longitudinal sectional view of the mine machine light.
FIG. 4*a* is a fragmentary cross-sectional view of the inspection end cap.
FIG. 4*b* is a fragmentary cross-sectional view of an annular side wall, both for showing a preferred manner of mounting the glass plates therein.

The mine machine light 10 includes a housing or casing 12 that is generally triangular in transverse cross sectional shape (FIG. 3).

For sake of easy discussion, let us assume the attitude shown in FIGS. 3 and 4 is the attitude that the light would have in use upon a mining machine, since this is a likely one.

Thus, the housing 12 includes a metal body 14 that is preferably a casting. In small numbers, it could be fabricated of plate. The body 14 has a flat, generally rectangular floor or base 16, which has laterally extending flanges or ears 18. The light is secured to a mine machine (or other mounting), e.g. by inserting bolts through the holes 20 in the flanges 18. Of course the flanges 18 could be tack welded to the mine machine or the flanges 18 could be bolted to a plate (not shown) that was, in turn tack welded to the mine machine.

The body 14 further includes a narrow generally rectangular outer wall 22, distally of the base 16. Two generally rectangular annular opposite side walls 24 each have a first long margin in common with a respective long margin of the base 16 and a second long margin in common with a respective long margin of the outer wall 22. There are two opposite, generally triangular end walls, a holder cap end 26 and an inspection cap end 28.

Each end wall 26, 28 has a respective centrally placed, internally threaded opening 30, 32 therethrough.

Each side wall 24 resembles a picture frame, in comprising a broad marginal portion 34 which extends around the whole perimeter thereof. At its inner edge, the margins 34 are reduced in thickness, from the outside, to provide an inner perimetrical flange 36 with a planar shoulder surface 38 which faces outwardly, surrounded by a recess surface 40 that is generally normal to the shoulder 38. In the margin 34, several perimetrically spaced, internally threaded, outwardly opening sockets 41 are provided.

An exteriorly threaded end cap 42 in the form of a plug is provided for closing the opening 30, while providing a passageway along the threading for cooling off escaping gas should a bulb burst.

The electrical service cable 44 is admitted through protective conduit 45 and into the sealing fitting 46 secured in the cap 42 to serve the socket 48. The socket 48 is mounted to the inside of the cap 42 via the screws 50. A retainer 52 prevents the gland 46 from backing away from providing a secure, sealed connection.

Within the housing, an electric light bulb 54 is received in the socket 48. The bulb may be of any type in such use. Presently incandescent, sodium vapor and mercury vapor lamps are used.

The opening 32 in the inspection end wall 28 is closed by an exteriorly threaded inspection cap 70 of plug-shape. The exterior threading 72 on the cap 70 is provided on an axially inwardly projecting flange 74 which has an annular, axially inwardly facing shoulder 76 within its lumen, near its base. The path along the helical threading 72 provides another cooling outlet for gases should a bulb burst. An inspection glass plate 78 is received in the recess so defined within the cap flange 74 and secured, e.g., by being sealed at 80, to the internal surface 82 of the cap flange 74. Snap ring 83 is installed in a groove 85, in cap 70, as shown, providing a backing for the glass plate 78.

The recess within the flange 74 is axially deeper than the glass plate 78 is thick, so when the plate 78 is installed, a shallower recess 79 remains radially within the flange 74, axially inwardly of the glass plate 78. Here, a helical compression spring 84 is received against the axially inner face of the snap ring 83, so that when the cap 70 is screwed in place, the spring bottoms on the snap ring 83 in the shallow recess 79, compresses and resiliently supports the outer end of the bulb 54, which it engages.

One important key to the construction as shown in FIG. 3 is the aforementioned recess 38, 40 in the sidewalls. These receive glass plates 86 whose rear and outer margins are sealingly secured, such as by silicon rubber sealant/adhesive to the surface 40. Then a respective rectangular, annular retainer 88 is placed against each sidewall exterior, engaging the bridging between the recess 38, 40 is uniformly deeper than the glass plates 86 are thick, thus enabling the plates to be resiliently displaced within the recess as the compliant seal remains intact, thereby enhancing impact absorption. The retainers 88 have holes 90 through them corresponding in location to the threaded sockets 41. Screws 92 are threaded into the sockets 41 through the openings 90 to mechanically retain the glass plates in place.

If desired or needed, the glass plates may be faced as at 17 with shatter resisting plastic film, reinforcing wire mesh or the like. The plastic tape that is preferred for this use suppresses glare and provides abrasion and impact protection.

Note that should the light be placed in service so that its outer wall 22 faces outwardly and/or upwardly, i.e. forwardly with respect to the direction from which a shower of rocks or other mechanical impacts can be expected, there is a good likelihood the impacts will strike the wall 22 and bounce off, or strike only a glancing blow upon the glass plate 86.

However, should an impact break a plate 86, there is no need to discard the light 10. Rather, the respective screws 92 and retainer 88 are removed, the broken lens, window, glass plate 86 is removed and the channel 36, 38 is cleaned out. A suitable solvent may be used. Then, a new glass plate is adhered and secured in place as described above.

The glass plate 86 may be of any approved type, and may even be a composite of wire and glass, plastic and glass, etc., as is known in the art.

The body of the housing may be cast of, e.g. commercial grade 319 aluminum alloy or welded mild carbon steel plate.

Screws 94 are received through respective notches 96 in the end caps into threaded sockets 97 in the respective housing end walls to retain the end caps against threadably backing out of the respective openings 30 and 32.

Items 11, 13 and 15 are name plates, serial number plates, instruction plates or the like, e.g. held in place by adhesive means or, e.g., screws 19.

It should now be apparent that the mine machine light as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A mine machine light, comprising:

a housing having a unitary body of hollow, generally triangular transverse cross-sectional shape;

said body including a generally rectangular base wall, an outer wall that is generally rectangular, and substantially narrower than said base wall, two generally rectangular sidewalls, each having one respective margin shared with a respective margin of the base wall and an opposite respective margin shared with a respective margin of the outer wall, and a respective generally triangular wall each with an outer margin perimetrically joined to respective ends of the two sidewalls, the base wall and the outer wall;

a light socket within the housing;

gland means in one end wall for sealingly passing an electrical cable through that end wall to connect with the light socket; and means defining an opening through each sidewall;

means defining an outwardly facing shoulder on each sidewall perimetrically bordering the respective opening, each shoulder being recessed below the exterior of the respective sidewall;

a plate of light transmitting material received in each opening against the respective shoulder to close the respective opening and thus provide a window to the exterior of the housing;

means perimetrically securing each plate against the respective shoulder.

2. The mine machine light of claim 1, wherein:

the securing means for each plate comprises an adhesive/sealant interposed between the respective plate and the respective shoulder.

3. The mine machine light of claim 2, wherein:

the securing means further comprises a respective bezel fitted against each respective plate and the respective sidewall; and means mechanically securing the respective bezels to the respective sidewalls.

4. The mine machine light of claim 3, wherein:

the mechanical securing means is constituted by threadably, exteriorly removable fasteners, so that said plates may be individually removed from the exterior of the housing for replacement if broken.

5. The mine machine light of claim 3, further comprising:

means defining an interiorly threaded opening through each end wall of the housing, and an exteriorly threaded plug removably threaded into each respective opening and having a path helically proceeding along the threading thereof for the cooling escape of gases should a light bulb burst within the housing, said gland being provided through one said plug, whereby the housing is provided with an explosion-proof character for mine use.

6. The mine machine light of claim 5, further comprising:

a lamp secured in said socket, an electric cable electrically connected to said socket and exiting from the housing through said gland.

7. The mine machine light of claim 6, further comprising:

a compression coil spring resiliently compressed between the opposite end wall from said socket, and said lamp for supporting said lamp distally of said socket.

8. The mine machine light of claim 2, wherein the adhesive sealant is made of resilient material and provides a resilient mounting of said plates.

* * * * *